US006874611B2

(12) United States Patent
Lundblad

(10) Patent No.: US 6,874,611 B2
(45) Date of Patent: Apr. 5, 2005

(54) TELLER MACHINE FOR THE INFEED AND OUTFEED OF BANKNOTES

(75) Inventor: Leif Lundblad, Stockholm (SE)

(73) Assignee: Nybohov Development AB, Stockholm (SE)

( * ) Notice: Subject to any disclaimer, the term of this patent is extended or adjusted under 35 U.S.C. 154(b) by 65 days.

(21) Appl. No.: 10/275,976

(22) PCT Filed: Jun. 7, 2001

(86) PCT No.: PCT/SE01/01277

§ 371 (c)(1),
(2), (4) Date: Nov. 19, 2002

(87) PCT Pub. No.: WO01/99041

PCT Pub. Date: Dec. 27, 2001

(65) Prior Publication Data

US 2003/0106770 A1 Jun. 12, 2003

(30) Foreign Application Priority Data

Jun. 16, 2000 (SE) ..... 002249

(51) Int. Cl.[7] ..... G07F 7/04
(52) U.S. Cl. ..... 194/209; 340/568.7
(58) Field of Search ..... 194/209, 208, 194/206, 207, 205; 340/541, 550, 568.7; 235/128; 382/112, 135

(56) References Cited

U.S. PATENT DOCUMENTS 4,346,851 A * 8/1982 Bernardi et al. ..... 241/159
5,039,020 A 8/1991 Leuthold et al. ..... 241/30
5,310,036 A 5/1994 Hell ..... 194/206
5,975,274 A * 11/1999 Novak et al. ..... 194/206
6,351,552 B1 * 2/2002 Weaver et al. ..... 382/135

FOREIGN PATENT DOCUMENTS

EP 0 612 042 8/1994 ..... G07D/7/00
EP 0 710 934 5/1996 ..... G07D/7/00
WO WO 99/27488 * 6/1999 ..... G06K/9/00

* cited by examiner

*Primary Examiner*—Donald P. Walsh
*Assistant Examiner*—Mark J. Beauchaine
(74) *Attorney, Agent, or Firm*—Jacobson Holman PLLC

(57) ABSTRACT

A teller machine for the infeed and outfeed of banknotes having detectors for checking respectively the quality, denomination and validity of banknotes. The detector for checking the validity of a banknote carries out on each deposited and by-passing banknote a check relating to a first number of validity criteria and with respect to a second number of validity criteria. This second number of validity criteria is included in the teller machine as a closed and sealed unit so as to be in a material form available to the validity detector but sealed to prevent unintended access thereto. Banknotes determined to be genuine and of low quality by the respective detectors may be destroyed within the teller machine upon receipt of an acceptance signal from a superordinate unit outside the teller machine.

3 Claims, 1 Drawing Sheet

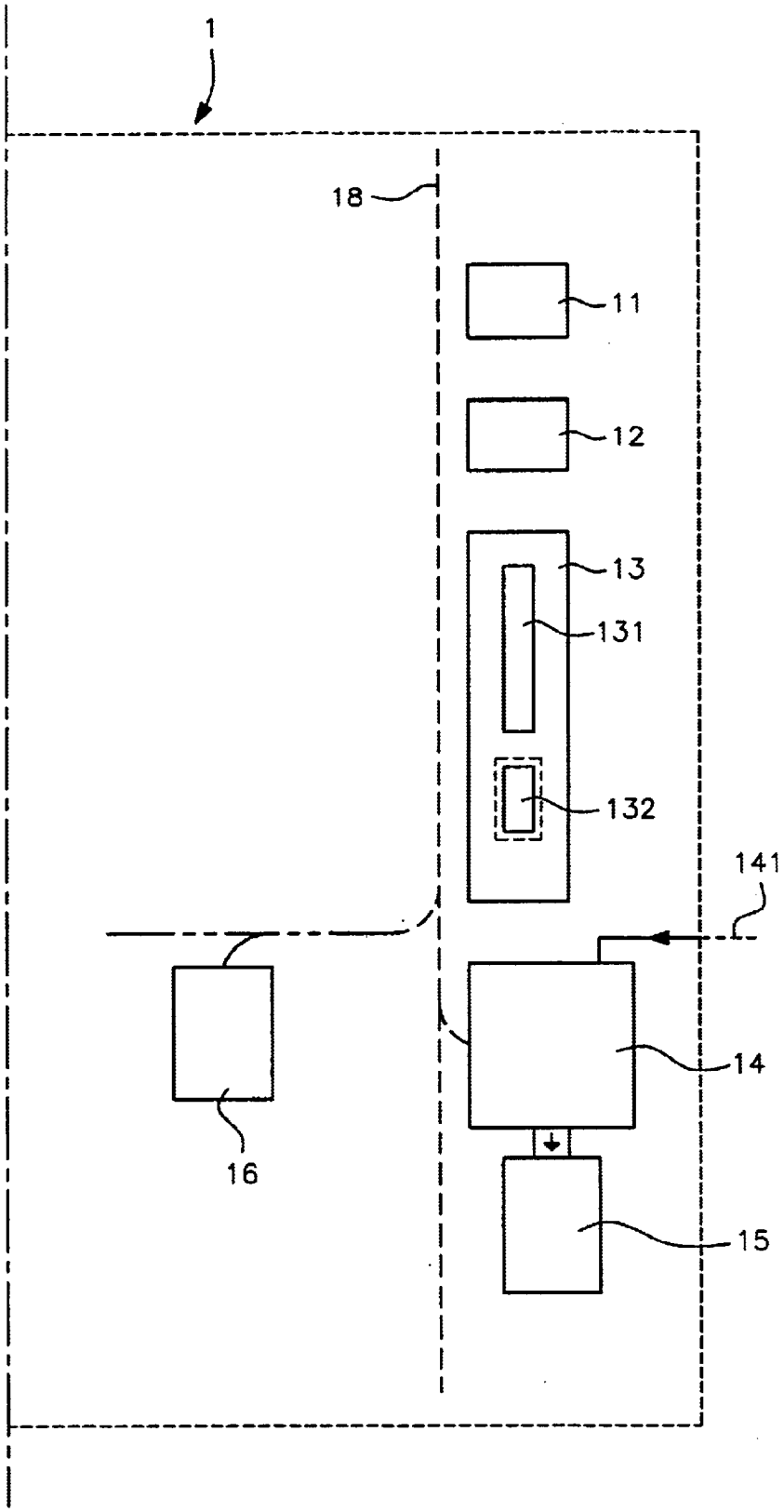
1
18
11
12
13
131
132
141
14
15
16

TELLER MACHINE FOR THE INFEED AND OUTFEED OF BANKNOTES

This is a nationalization of PCT/SE01/01277, filed Jun. 7, 2001 and published in English.

FIELD OF INVENTION

The present invention relates to a teller machine for the infeed and outfeed of banknotes, and particularly to such machines that include detector means for checking the quality, denomination and validity of deposited banknotes.

DESCRIPTION OF THE BACKGROUND ART

Teller machines for the infeed and outfeed of banknotes, either singly or in bundles, are known to the art. These machines may be equipped with detector devices of mutually different kinds and designs, e.g. for checking the quality, denomination and validity of the banknotes.

Also known to the art are teller machines which are adapted to bundle and package banknotes, to destroy valuable paper under controlled forms, and also to recover the waste generated by such destruction in a secure manner.

In view of the enormous quantity of banknotes that are in circulation despite the use of cheques, bills of exchange and other money substitutes, it is extremely important that dirty, wrinkled and more or less significantly torn banknotes are taken out of general circulation and replaced with newly printed banknotes. It is equally as important that any forged banknotes detected are removed at an early stage for investigation of possibly active gangs of forgerers. It is in itself evident that this clearing work must take place with the uttermost correctness under secure forms and controls. In Sweden, it the National Bank that is responsible for ensuring that this takes place.

The withdrawal and destruction of used, forged banknotes shall thus take place under the care and control of the National Bank. This means both comprehensive and expensive handling of these banknotes before they finally reach the National Bank for "final storage".

The expensive handling of banknotes involved has been indicated several times in the preceding paragraphs. One object of the present invention is to organise decentralised destruction of principally used banknotes while under the supervision by the National Bank in secure and economically favourable forms. The invention also affords a significant time gain, in that destruction of the banknotes takes place at an earlier stage than was hitherto the case (closer the centres of pulsating business life) while necessary checking (counting) of banknotes are fewer and the transportation of banknotes also fewer and shorter.

SUMMARY OF THE INVENTION

In view of these and other objects, the present invention is directed to an integrated teller machine having a quality detector, a denomination detector and a validity detector therein for checking quality, denomination and validity, respectively, of the banknotes fed into the teller machine. The validity detector is adapted to carry out with each deposited banknote a check relating to a first number of validity criteria and with respect to a second number of validity criteria. The second number of validity criteria are included in the teller machine in a material and detector-available form as a closed and sealed unit. Also within the teller machine and downstream of the detectors is a destruction unit for destroying banknotes that have been classed both as genuine by the validity detector and as low quality by the quality detector. According to the present invention, the destruction process is initiated only upon receipt by the destruction unit of an acceptance signal from a unit outside the teller machine that is superordinate to and independent of the teller machine.

DESCRIPTION OF A PREFERRED EMBODIMENT

Further scope of applicability of the present invention will become apparent from the detailed description given hereinafter. However, it should be understood that the detailed description and specific example, while indicating a preferred embodiment of the invention, is given by way of illustration only, since various changes and modifications within the spirit and scope of the invention will become apparent to those skilled in the art from this detailed description.

The present invention will now be described with reference to the accompanying drawing which schematically illustrates an inventive teller machine.

The drawing illustrates part of a teller machine 1 for the infeed and outfeed of banknotes. More specifically, the drawing illustrates a detector 11 for checking the quality of the deposited banknotes, a detector 12 for checking the denomination of deposited banknotes, and a detector 13 for checking the validity of deposited banknotes. Deposited banknotes are thus transported singly past the detectors 11, 12 and 13 on a banknote transporter 18, and banknotes that are found to fulfil the requirements of detectors 11 and 13 with respect to quality and validity are then transported further in accordance with the outcome of the detected denomination, for storage or packaging in respect of their respective denominations.

The validity control detector 13 is adapted to carry out on each deposited banknote a check relating to a first plurality of validity criteria 131 and to a second plurality of validity criteria 132. In a materialised form and a form available to the detector 13, this second plurality of validity criteria 132 is included in the teller machine as a closed and sealed unit. By sealed is meant that the unit cannot be opened and the criteria made available in a manner not intended, without being noticed, or that the unit, and therewith the criteria, is destroyed if an attempt to burglar the unit is made. The first number of criteria are known to the manufacturer of the teller machine (may be more or less known generally), whereas the second number of criteria are known solely by units that are independent of and superordinate to the owner of the teller machine. This means that if the unit is the National Bank for instance, it is this bank which has, in principle, control over certain functions in the teller machine, as described in more detail hereinafter.

A destruction unit 14 disposed downstream of the detectors 11, 12, 13 in a teller machine is adapted to destroy banknotes 1) classed by the detector 13 for carrying out validity checks as genuine, and 2) also classed as low quality by the detector 11 that carries out quality checks; genuinity and low quality shall thus exist simultaneously, but destruction of the banknotes is not undertaken until an acceptance signal has arrived (via 141) from the unit which is superordinate and independent of the teller apparatus 1 (in this case, the National Bank as described above). This acceptance means that the National Bank has already received information (denomination, serial numbers, quantities) concerning banknotes intended for destruction. In the absence of an acceptance signal, traditional routines are followed, i.e.

the banknotes are sent to the National Bank for destruction under secure forms. The superordinate unit thus itself checks whether a banknote for which a decision on destruction has been taken, really shall be destructed. This unit also checks whether or not the decision has been put into effect, i.e. that destruction has taken place or has not taken place, and that the banknote instead is rejected for examination.

The traditional central destruction routine has thus been replaced with a more simple and therewith more secure and more economic routine which is decentralized to a plurality of locations (teller machines).

Arranged downstream of the detector 13 for validity checks is a collecting unit 16 for collecting those banknotes that have been classed by the detector as forged banknotes for later manual checks.

A collecting unit 15 for secure collection of waste from the destruction device is arranged downstream of the destruction unit 14.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. An integrated teller machine for the infeed and outfeed of banknotes, comprising:

a quality detector, a denomination detector and a validity detector within said teller machine for checking quality, denomination and validity, respectively, of the banknotes fed into said teller machine;

said validity detector carrying out, for each banknote deposited into said machine, a check with respect to a first number of validity criteria and to a second number of validity criteria, said second number of validity criteria being included within said teller machine as a closed and sealed unit such that said second number of validity criteria are in a material form available to said validity detector but sealed to prevent unauthorized access thereto; and a destruction unit downstream of said detectors and within said teller machine for destroying banknotes that have been classed both as genuine by said validity detector and as low quality by said quality detector, said destruction being initiated only upon receipt by said destruction unit of an acceptance signal from a unit outside said teller machine that is superordinate to and independent of said teller machine.

2. The integrated teller machine as set forth in claim 1, further comprising a collecting unit downstream of said validity detector and within said teller machine to collect banknotes which have been classed as forgeries by said validity detector for subsequent manual check.

3. The integrated teller machine as set forth in claim 1, wherein said unit outside said teller machine that sends the acceptance signal is a bank, said bank checking information relating to denomination, serial numbers and quantities of banknotes intended for destruction to determine whether destruction within said teller machine should be carried out by said destruction unit.

* * * * *